US008133080B2

(12) United States Patent
Murakami

(10) Patent No.: US 8,133,080 B2
(45) **Date of Patent: *Mar. 13, 2012**

(54) ELECTRONIC APPARATUS AND CONNECTOR

(75) Inventor: Yutaka Murakami, Akishima (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/218,203

(22) Filed: Aug. 25, 2011

(65) Prior Publication Data

US 2011/0312195 A1 Dec. 22, 2011

Related U.S. Application Data

(63) Continuation of application No. 12/557,426, filed on Sep. 10, 2009, now Pat. No. 8,029,321, which is a continuation of application No. 12/355,579, filed on Jan. 16, 2009, now Pat. No. 7,819,702.

(30) Foreign Application Priority Data

May 28, 2008 (JP) ..... 2008-139554

(51) Int. Cl.
*H01R 33/00* (2006.01)

(52) U.S. Cl. ..... 439/660

(58) Field of Classification Search ..... 439/660, 439/374, 607.02, 607.04, 607.35, 495, 630
See application file for complete search history.

(56) References Cited

U.S. PATENT DOCUMENTS 6,783,399 B2 8/2004 Joung
7,070,453 B1 7/2006 Chen
7,164,577 B2 1/2007 Minaguchi et al.
7,371,116 B2 * 5/2008 Chiang ..... 439/607.34
7,517,253 B1 4/2009 Chiang
7,819,702 B2 * 10/2010 Murakami ..... 439/660
8,029,321 B2 * 10/2011 Murakami ..... 439/660
2005/0111202 A1 5/2005 Minaguchi et al.

(Continued)

FOREIGN PATENT DOCUMENTS

CN 1501319 6/2004

(Continued)

OTHER PUBLICATIONS

Explanation of Non-English Language References.

(Continued)

*Primary Examiner* — Tulsidas C Patel
*Assistant Examiner* — Phuong Nguyen
(74) *Attorney, Agent, or Firm* — Knobbe Martens Olson & Bear, LLP

(57) ABSTRACT

According to one embodiment, a module comprises a connector into which a first plug and a second plug are insertable. The connector includes a housing and a terminal portion provided in the housing. The housing includes an insertion opening part which exposes the terminal portion outside, a back part positioned at an end part opposite to the insertion opening part in the housing, and a side part provided between the insertion opening part and the back part and configured to oppose to the plug when the plug is inserted into the connector. The side part includes an inclined part which continues to the insertion opening part and is inclined such that a distance between the inclined part and the plug increases in a direction from the back part toward the insertion opening part to form a gap between the inclined part and the plug.

13 Claims, 9 Drawing Sheets

U.S. PATENT DOCUMENTS

| | | | |
|---|---|---|---|
| 2007/0173121 | A1 | 7/2007 | Chiang |
| 2009/0130921 | A1 | 5/2009 | Chiou |
| 2009/0233494 | A1 | 9/2009 | Wang |

FOREIGN PATENT DOCUMENTS

| | | |
|---|---|---|
| CN | 2930015 | 8/2007 |
| CN | 201112885 | 9/2008 |
| CN | 201160184 | 12/2008 |
| JP | 2000-123908 | 4/2000 |
| JP | 2005-157790 | 6/2005 |
| JP | 2005-353517 | 12/2005 |
| JP | 2006-164712 | 6/2006 |
| JP | U3148335 | 1/2009 |

OTHER PUBLICATIONS

Notification of Reasons for Rejection issued by the JPO in the corresponding Japanese Patent Application No. 2008-139554 on Mar. 17, 2009 in 5 pages.

Office Action issued in Chinese application No. 200910003529.8 on Apr. 8, 2011 in 10 pages.

* cited by examiner

ELECTRONIC APPARATUS AND CONNECTOR

CROSS-REFERENCE TO RELATED APPLICATIONS

This is a continuation of U.S. patent application Ser. No. 12/557,426, filed Sep. 10, 2009, which is a continuation of U.S. patent application Ser. No. 12/355,579, filed Jan. 16, 2009, now U.S. Pat. No. 7,819,702, which is based upon and claims the benefit of priority from Japanese Patent Application No. 2008-139554, filed May 28, 2008, the entire contents of each which are incorporated herein by reference.

BACKGROUND

1. Field

One embodiment of the invention relates to a connector to which a USB cable is connectable, and an electronic apparatus comprising the connector.

2. Description of the Related Art

An electronic apparatus such as a portable computer is provided with a Universal Serial Bus (USB) connector to which a USB cable is connectable. Such a USB connector generally comprises a metal housing (i.e., shell) and a terminal portion provided in the housing. At a distal end portion of the USB cable, a plug (i.e., a terminal portion) insertable into the housing of the USB connector is provided.

Jpn. Pat. Appln. KOKAI Publication No. 2005-353517 discloses a memory card socket which prevents inclined insertion of a memory card. The memory card socket comprises entrance guide tapers at an open end of a base shell. The memory card socket further comprises stoppers covering the entrance guide tapers.

In the case where a housing of a connector is formed of metal, even if the user pulls a USB cable connected to the connector in a lateral direction, a plug of the USB cable is damaged, but a terminal portion of the connector often avoids being damaged.

In the case where the housing of the connector is formed of synthetic resin, however, if the user pulls a USB cable connected to the connector in a lateral direction, the housing is deformed and heavy load is applied to a terminal portion of the connector. This may cause damage to the terminal portion of the connector.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an electronic apparatus comprises a case comprising an opening part, and a connector contained in the case and exposed outside of the case through the opening part and into which a plug of a USB cable is insertable. The connector comprises a housing and a terminal portion provided in the housing. The housing comprises an insertion opening part which exposes the terminal portion outside of the housing, a back part positioned at an end part opposite to the insertion opening part in the housing, and a side part provided between the insertion opening part and the back part and configured to oppose to the plug of the USB cable when the plug is inserted into the connector. The side part comprises an inclined part which continues to the insertion opening part and is inclined such that a distance between the inclined part and the plug increases in a direction from the back part toward the insertion opening part to form a gap between the inclined part and the plug.

In general, according to one embodiment of the invention, a connector into which a plug of a USB cable is insertable, comprises a housing and a terminal portion provided in the housing. The housing comprises an insertion opening part which exposes the terminal part outside of the housing, a back part positioned at an end part opposite to the insertion opening part in the housing, and a side part provided between the insertion opening part and the back part and configured to oppose to the plug of the USB cable when the plug is inserted into the connector. The side part comprises an inclined part which continues to the insertion opening part and is inclined such that a distance between the inclined part and the plug increases in a direction from the back part toward the insertion opening part to form a gap between the inclined part and the plug.

Figure 1:
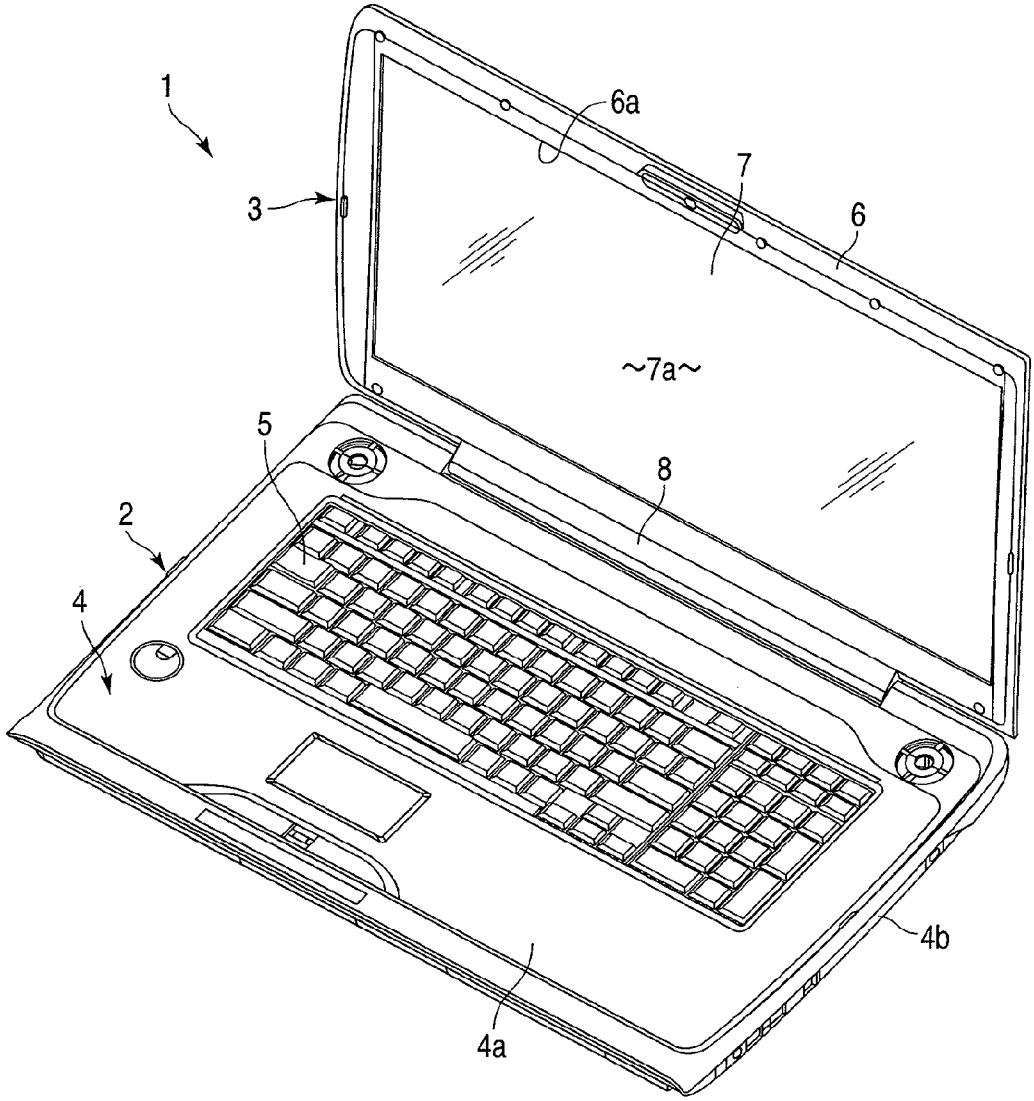
FIG. 1 is an exemplary perspective view of a portable computer according to an embodiment of the invention.

Hereinafter, an embodiment of the present invention will be described with reference to the drawings in which the present invention is applied to a portable computer. FIGS. 1-9 disclose a portable computer 1 as an electronic apparatus according to an embodiment of the present invention. As shown in FIG. 1, a portable computer 1 comprises a main unit 2 and a display unit 3.

As shown in FIG. 1, the main unit 2 comprises a case 4. The case 4 is formed in a flat-box shape and comprises an upper wall 4*a*, a peripheral wall 4*b*, and a lower wall 4*c*. The upper wall 4*a* supports a keyboard 5. The case 4 contains, for example, a circuit board as a mother board.

The display unit 3 comprises a display housing 6 and a display device 7 contained in the display housing 6. An example of the display device 7 is a liquid crystal display. The display device 7 comprises a display screen 7*a*. The display screen 7*a* is exposed to the outside through an opening part 6*a* provided on a front wall of the display housing 6.

As shown in FIG. 1, a hinge part 8 is provided at the rear edge of the main unit 2. The hinge part 8 swingably couples the display unit 3 to the main unit 2. The display unit 3 is thereby swingable between a first position in which the display unit 3 is bent covering the upper wall 4*a* and a second position in which the display unit 3 is raised from the upper wall 4*a*.

Figure 2:
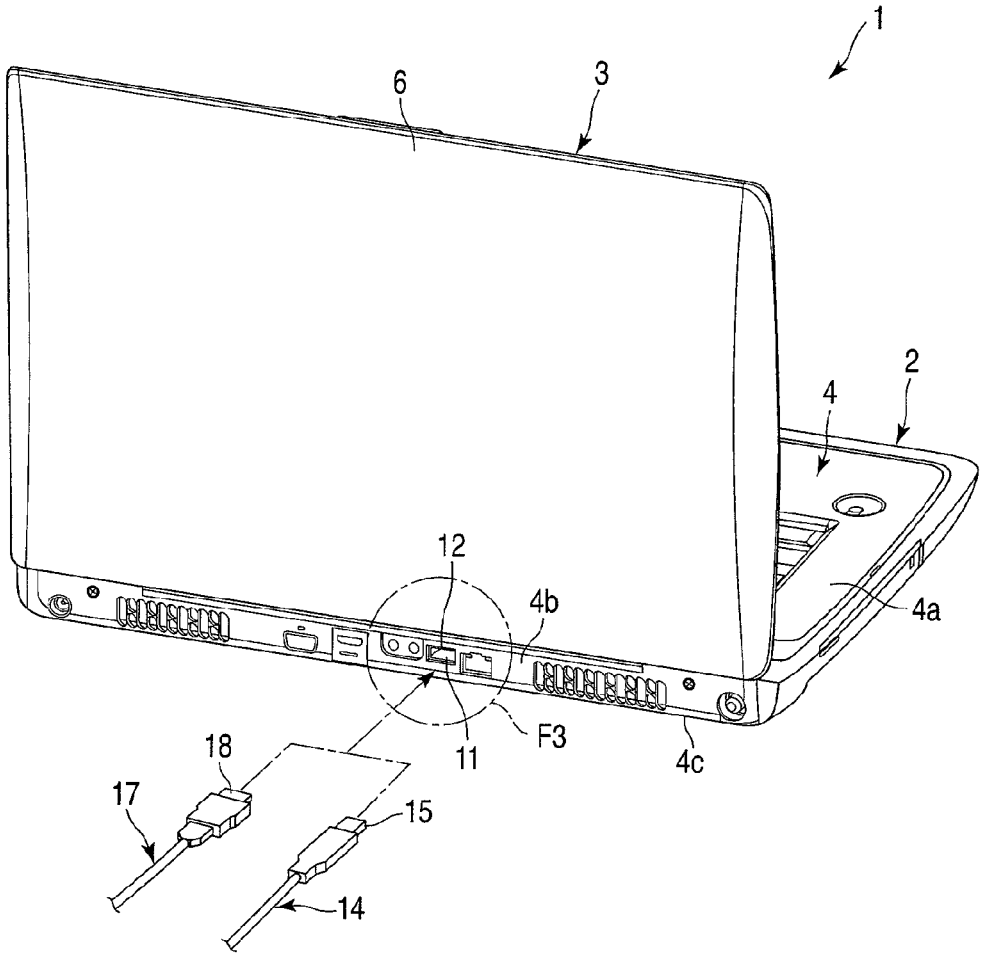
FIG. 2 is an exemplary perspective view of a portable computer according to the embodiment of the present invention.
Figure 3:
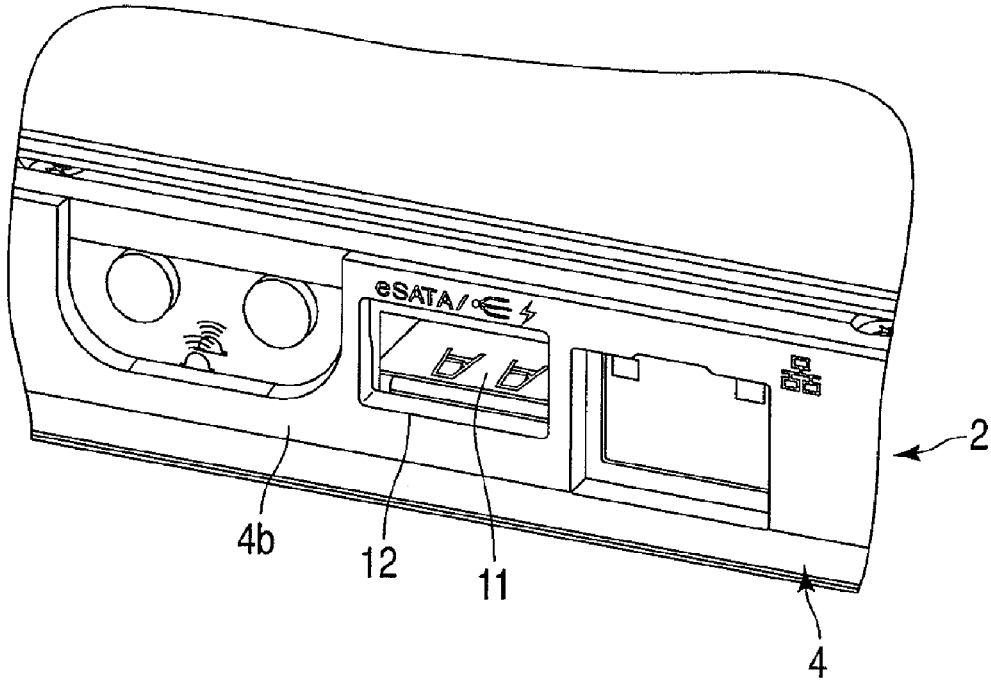
FIG. 3 is an exemplary perspective view in enlarged detail of a region surrounded by line F3 of the portable computer shown in FIG. 2.

As shown in FIGS. 2 and 3, the main unit 2 comprises a connector 11. The connector 11 is an example of a "connector" as referred to by the present invention. The present invention refers to a socket as a "connector", which denotes a receptacle for a plug (i.e., a terminal portion) of a cable.

As shown in FIGS. 2 and 3, the connector 11 is mounted on the circuit board, for example, and contained in the case 4. The peripheral wall 4*b* of the case 4 comprises an opening part 12 which faces the connector 11. The connector 11 is exposed to the outside of the case 4 through the opening part 12. A plug 15 of a USB cable 14 is insertable (i.e., connectable) into the connector 11.

Next, a connector 11 according to the embodiment will be described in detail.

As shown in FIG. 2, the connector 11 according to an embodiment of the present invention is an eSATA/USB combo connector which is selectively connectable to the USB cable 14 or an External Serial ATA (eSATA) cable.

Figure 4:
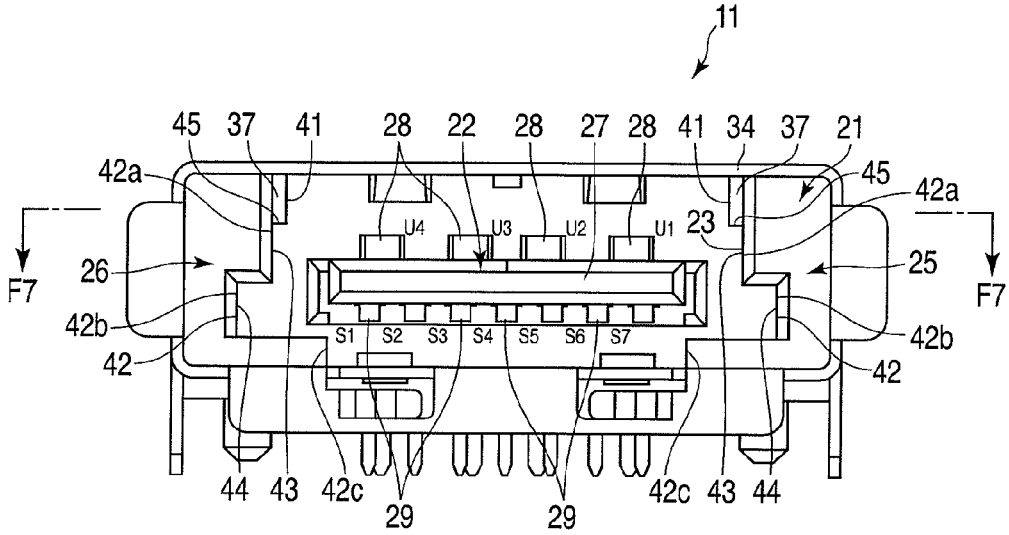
FIG. 4 is an exemplary front view of a connector according to the embodiment of the present invention.
Figure 7:
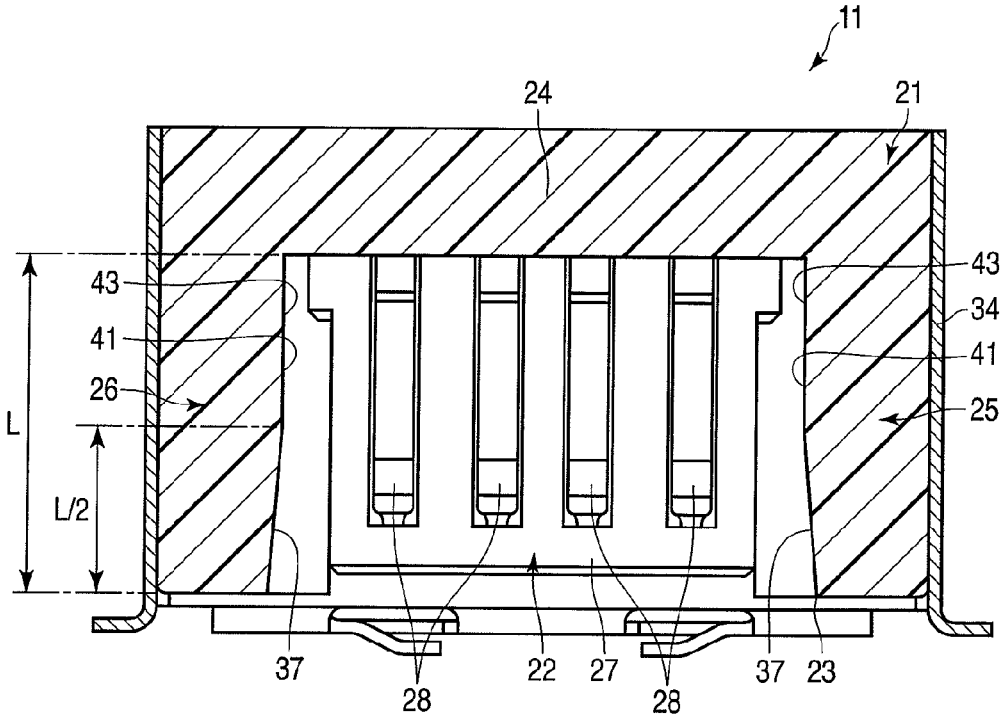
FIG. 7 is an exemplary cross-sectional view along line F7-F7 of the connector shown in FIG. 4.

As shown in FIG. 4, the connector 11 according to the present embodiment comprises a housing 21 and a terminal portion 22 provided in the housing 21. The housing 21 is formed of synthetic resin. As shown in FIG. 7, the housing 21 comprises an insertion opening part 23, a back part 24, and first and second side parts 25, 26, forming a pair of side parts, and has an open-ended U-shaped horizontal section.

As shown in FIG. 7, the insertion opening part 23 is provided at one of the end portions (such as a front-end portion) of the housing 21, and is exposed to the outside of the housing 21. The insertion opening part 23 exposes the terminal portion 22 to the outside of the housing 21. In the housing 21, the back part 24 is positioned at the other end portion (such as a back-end portion) opposite to the insertion opening part 23. The back part 24 links back-end portions of the first and second side parts 25, 26, and forms a bottom of the housing 21.

Each of the first and second side parts 25, 26 is provided between the insertion opening part 23 and the back part 24. Further, the first and second side parts 25, 26 separately extend on either side of the terminal portion 22 to interpose the terminal portion 22 therebetween.

The side parts 25, 26 are guide portions which guide the plug 15 of the USB cable 14 or a plug 18 of the eSATA cable 17 from the insertion opening part 23 to the back part 24, and are support members which support the plug 15 or 18 inserted into the connector 11. The plug 15 (i.e., the USB plug 15) of the USB cable 14 comprises a metal shell, for example. The plug 18 (i.e., the eSATA plug 18) of the eSATA cable 17 comprises a shell formed of synthetic resin, for example.

Figure 5:
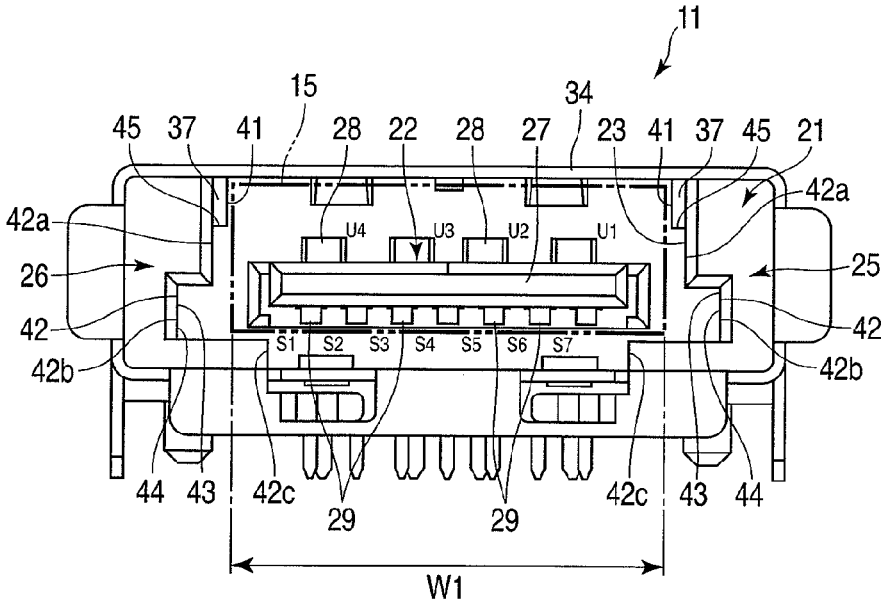
FIG. 5 is an exemplary front view of a connector according to the embodiment of the present invention.
Figure 6:
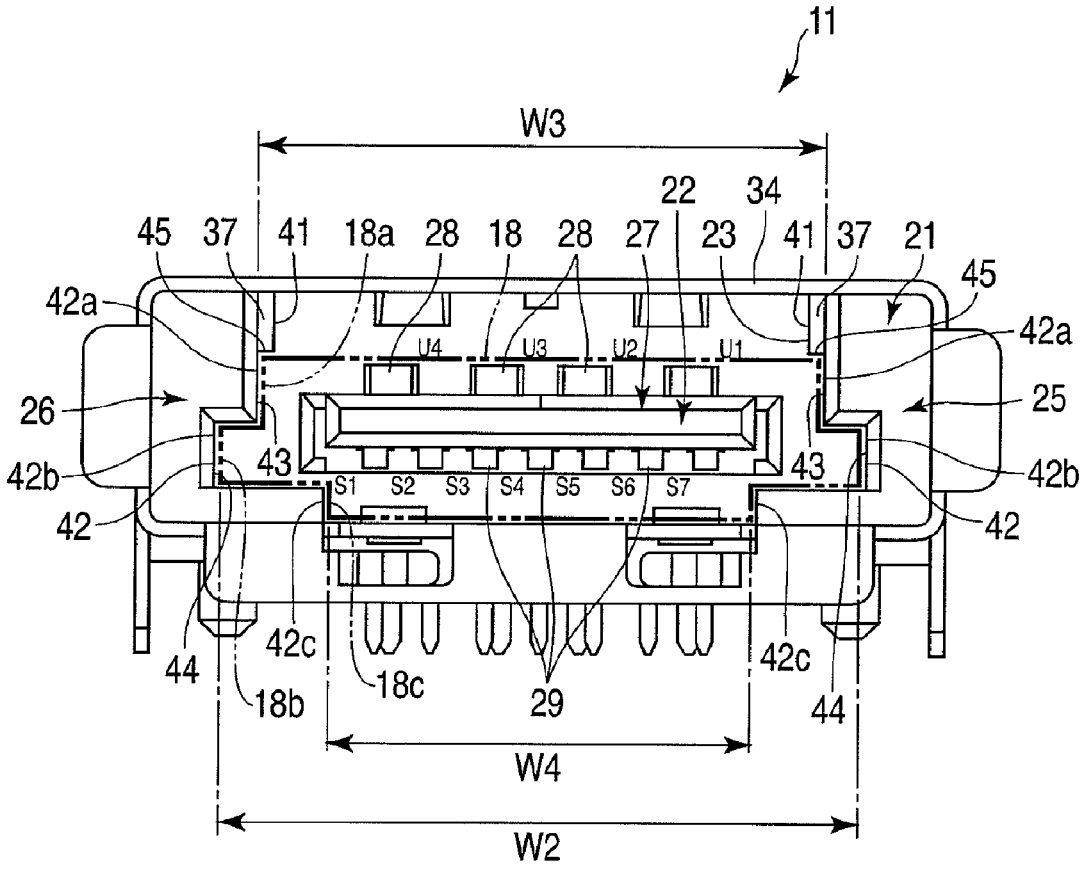
FIG. 6 is an exemplary front view of a connector according to the embodiment of the present invention.
Figure 8:
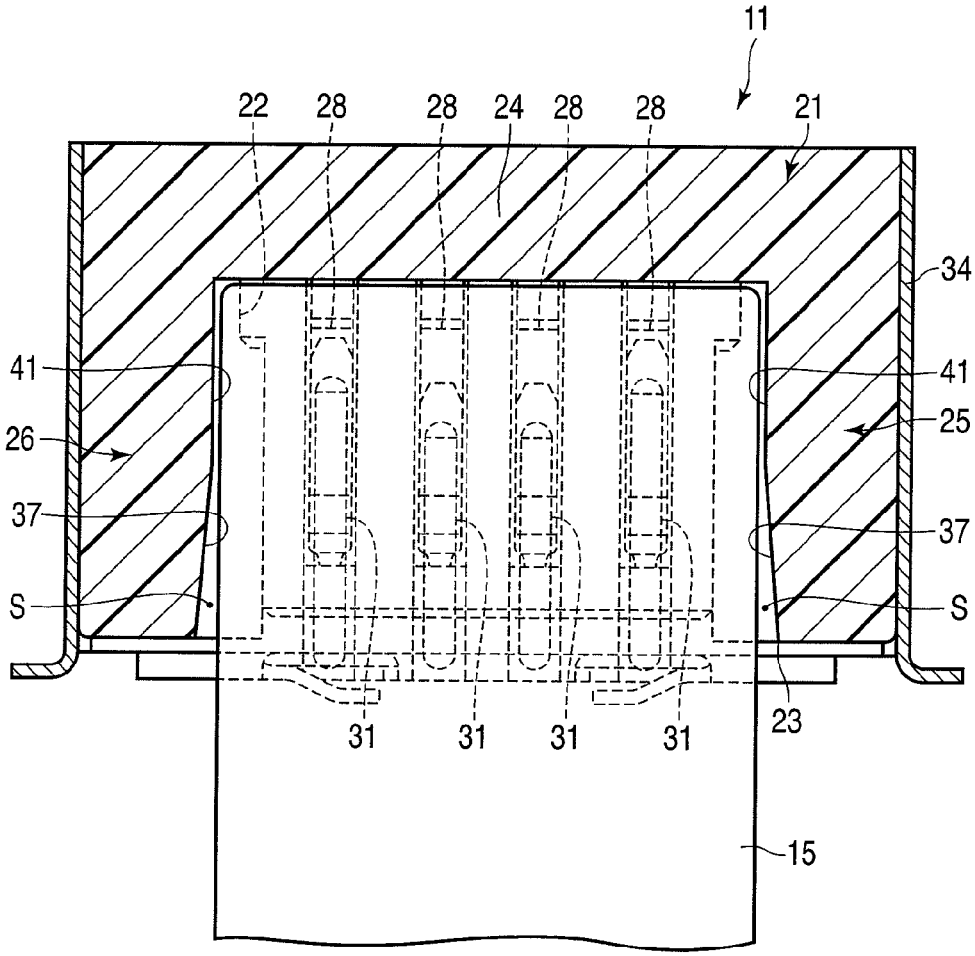
FIG. 8 is an exemplary cross-sectional view showing a normal state of the connector shown in FIG. 7, in which a USB cable is connected.

As shown in FIGS. 5, 6 and 8, the first and second side parts 25, 26 are configured to laterally oppose to the plug 15 of the USB cable 14 when the plug 15 is inserted into the connector 11. Further, the first and second side parts 25, 26 are configured to laterally oppose to the plug 18 of the eSATA cable 17 when the plug 18 is inserted into the connector 11.

The width W2 (see FIG. 6) of the plug 18 of the eSATA cable 17 is greater than the width W1 (see FIG. 5) of the plug 15 of the USB cable 14. The connector 11, which is an eSATA/USB combo connector, deals with the difference in width by means of the synthetic-resin housing 21, instead of providing a metal shell suited to the outer size of the USB plug 15. That is, the housing 21 is formed larger than the outer size of the plug 18 of the eSATA cable 17 such that the plug 18 of the eSATA cable 17 is insertable thereinto.

As shown in FIGS. 4 and 7, the terminal portion 22 of the connector 11 comprises a mold portion 27, a plurality of first terminals 28, and a plurality of second terminals 29. The mold portion 27 is formed in a flat shape, for example, and extends from the back part 24 to the vicinity of the insertion opening part 23 in the housing 21. The mold portion 27 is formed of synthetic resin and is integrally formed with the housing 21, for example.

The first terminals 28 are configured to connect to terminals 31 (see FIG. 8) of the plug 15 of the USB cable 14, for example. The number of the first terminals 28 is four, for example. As shown in FIG. 4, the first terminal 28 are provided on one surface (such as an upper surface) of the mold portion 27. The second terminals 29 are configured to connect to terminals (not shown) of the plug 18 of the eSATA cable 17, for example. The number of the second terminals 29 is seven, for example. The second terminals 29 are provided on another surface (such as a lower surface) of the mold portion 27 opposite to the surface on which the first terminals 28 are provided.

As shown in FIGS. 4 and 7, the connector 11 further comprises a shell member 34 formed of metal. The shell member 34 is attached to the housing 21 and covers an upper surface and right and left sides of the housing 21, for example.

Next, an inclined part 37 according to the present embodiment will be described.

As shown in FIG. 7, each of the first and second side parts 25, 26 comprises the inclined part 37. The inclined part 37 is provided in a region close to the insertion opening part 23 in each of the first and second side parts 25, 26, and continues to the insertion opening part 23. As shown in FIG. 8, the inclined part 37 is inclined such that the distance between the inclined part 37 and the plug 15 of the USB cable 14, inserted into the connector 11, increases in the direction from the back part 24 toward the insertion opening part 23 of the housing 21.

That is, the inclined part 37 is inclined such that the distance between the first and second side parts 25, 26 increases in the direction from the back part 24 toward the insertion opening part 23. When the plug 15 of the USB cable 14 is inserted into the connector 11, the inclined part 37 of each of the first and second side parts 25, 26 forms a gap S (i.e., clearance) between the inclined part 37 and the plug 15.

Figure 11:
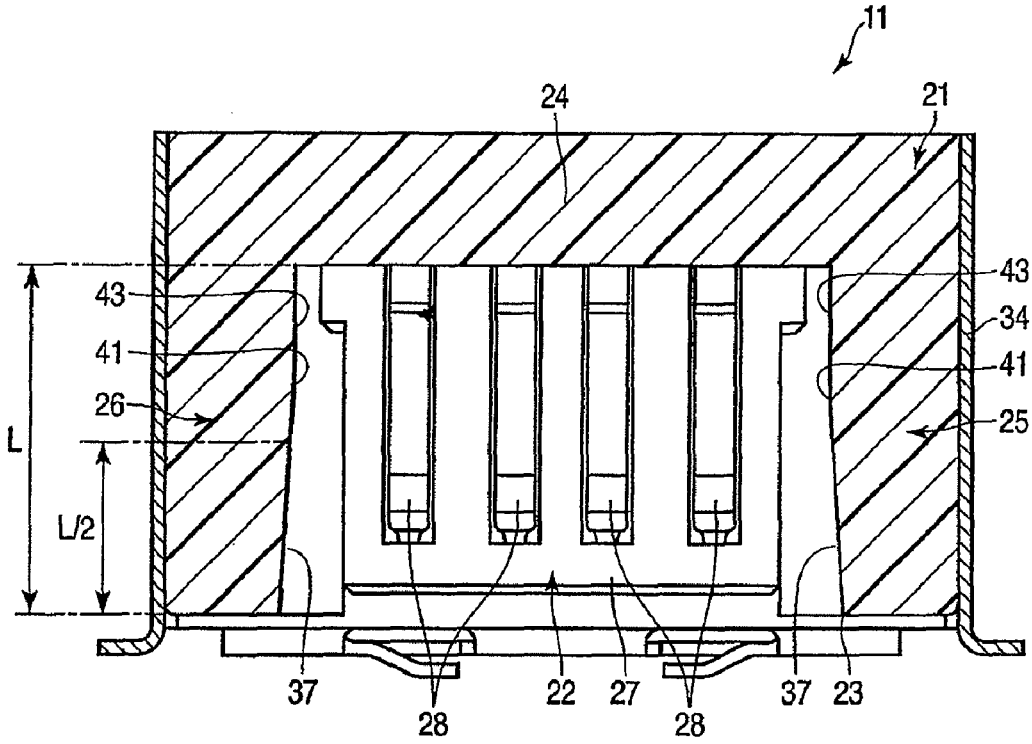
FIG. 11 is another exemplary cross-sectional view along line F7-F7 shown in FIG. 4.

As shown in FIG. 11, the inclined part 37 of each of the first and second side parts 25, 26 is formed longer than half the length of each of the side parts 25, 26 in the direction from the insertion opening part 23 toward the back part 24. That is, the inclined part 37 of each of the first and second side parts 25, 26 extends along a length of more than L/2 from the insertion opening part 23, where L denotes the length (i.e., the distance between the insertion opening part 23 and the back part 24) of each of the side parts 25, 26 in a direction from the insertion opening part 23 toward the back part 24. As an example, the inclined part 37 according to the present embodiment has half the length (i.e., L/2) of the side parts 25, 26 as shown in FIG. 7.

As shown in FIG. 4, each of the first and second side parts 25, 26 of the housing 21 comprises first and second guide portions 41, 42. As shown in FIGS. 5 and 8, the first guide portions 41 configured to guide the plug 15 of the USB cable 14 from the insertion opening part 23 to the back part 24. The gap between the first guide portion 41 of the first side part 25 and the first guide portion 41 of the second side part 26 is set to suit the width W1 of the plug 15 of the USB cable 14.

As shown in FIG. 6, the second guide portions 42 guide the plug 18 of the eSATA cable 17 from the insertion opening part 23 to the back part 24. The second guide portion 42 is formed to suit the outer size of the plug 18 of the eSATA cable 17.

That is, each of the second guide portions 42 comprises first to third portions 42*a*, 42*b*, 42*c*. The first portion 42*a* is adjacent to the first guide portion 41 and is configured to guide the first portion 18*a* of the plug 18 having a width W3. The second portion 42*b* is configured to guide the second portion 18*b* of a plug having a maximum width W2. The third portion 42*c* is configured to guide the third portion 18*c* of the plug 18 having a width W4.

The gap between the second guide portion 42 of the first side part 25 and the second guide portion 42 of the second side part 26 is set to suit the width of the plug 18 of the eSATA cable 17. That is, the second guide portion 42 is positioned nearer to a rim portion of the housing 21 than the first guide portion 41.

Further, each of the first and second side parts 25, 26 of the housing 21 comprises first and second regions 43, 44. As shown in FIG. 5, the first regions 43 are to be laterally opposed to the plug 15 of the USB cable 14 when the plug 15 of the USB cable 14 is inserted into the connector 11. As shown in FIG. 6, the second regions 44 are to be laterally opposed to the plug 18 of the eSATA cable 17 when the plug 18 of the eSATA cable 17 is inserted into the connector 11.

As shown in FIG. 4, each of the first regions 43 comprises a first guide portion 41 and most of a second guide portion 42. Each of the second region 44 comprises the second guide portion 42. That is, the first and second regions 43, 44 are partially overlapped with each other.

The inclined part 37 of each of the first and second side parts 25, 26 is provided in the first region 43. More specifically, the inclined part 37 of each of the first and second side parts 25, 26 is provided in a part (i.e., the first guide portion 41) of the first region 43 away from the second region 44. That is, the inclined part 37 of each of the first and second side parts 25, 26 is provided in a region to be away from a side of the plug 18 of the eSATA cable 17 when the plug 18 of the eSATA cable 17 is inserted into the connector 11. The inclined part 37 is formed over the overall height of the first guide portion 41.

As shown in FIG. 4, a step portion 45 provided by difference between the width W1 of the plug 15 of the USB cable 14 and the width W3 of the plug 18 of the eSATA cable 17 exists between the first guide portion 41 and the second guide portion 42. The inclined part 37 is provided in the step portion 45. That is, the amount of taper (i.e., the amount of lateral variation from one end to the other end of the inclined part 37) of the inclined part 37 according to the present embodiment is set to be the same as the width of the step portion 45.

Next, the operation of the connector 11 according to the present embodiment will be described.

Figure 9:
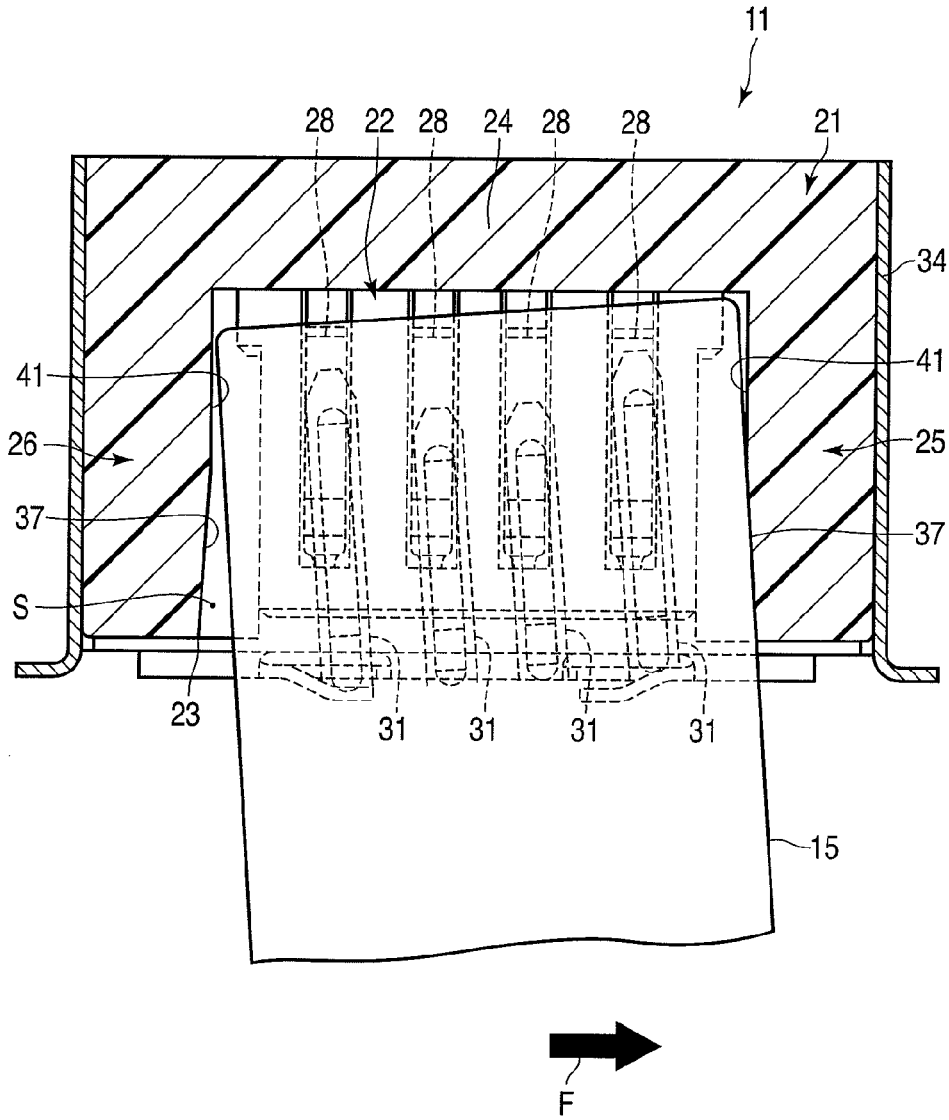
FIG. 9 is an exemplary perspective view of a state in which a lateral force is applied to the USB cable of the connector shown in FIG. 7.

FIG. 9 shows the action of a lateral force F on the USB cable 14 with the plug 15 of the USB cable 14 inserted into the connector 11. As shown in FIG. 9, the plug 15 of the USB cable 14 to which the lateral force F is applied is inclined from the normal position along the gap S formed by the inclined part 37, and thereby easily withdraws from the connector 11. When the lateral force F applied to the USB cable 14 exceeds a predetermined level, the plug 15 withdraws from the connector 11 spontaneously.

On the other hand, the plug 18 of the eSATA cable 17, having a shell formed of synthetic resin, is more flexible than metal. This causes little damage to the terminal portion 22 of the connector 11 even when the lateral force F is applied to the eSATA cable 17.

Figure 10:
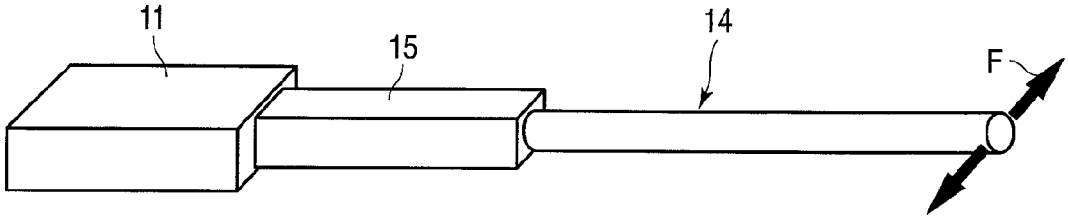
FIG. 10 is an exemplary perspective view schematically showing a load test of a connector.

With the connector 11 with the above-described configuration, the terminal portion 22 of the connector 11 can be prevented from being damaged. FIG. 10 shows an example of a load test on the connector 11. The load test on the connector 11 is performed by applying the lateral force F to the USB cable 14 with the plug 15 is inserted into the connector 11, and checking the state of the connector 11.

The present inventor conducted the load test on a connector (i.e., a connector in which the side parts 25, 26 are formed straight) not comprising the inclined part 37. The present inventor then confirmed that the plug 15 of the USB cable 14 does not withdraw from the connector 11 even when the lateral force F exceeds 30N, and that the synthetic-resin housing 21 is deformed rather significantly. The present inventor further confirmed that the terminal portion 22 reaches the critical limit and the mold portion 27 of the terminal portion 22 is damaged when the lateral force F exceeds approximately 40N.

In the case where the inclined part 37 configured to form the gap S (i.e., clearance or looseness) between the inclined part 37 and the plug 15 is provided as in the present embodiment, the plug 15 of the USB cable 14 to which the lateral force F is applied is inclined from the normal position and becomes easy to withdraw from the connector 11. The plug 15 then withdraws from the connector 11 spontaneously before the lateral force F reaches the level (i.e., threshold) at which the terminal portion 22 is damaged. The terminal portion 22 of the connector 11 is thereby prevented from being damaged even when a user excessively pulls the USB cable 14 inserted into the connector 11 in a lateral direction.

The present inventor conducted the load test on the connector 11 in which the inclined part 37 is provided. As a result, the present inventor has confirmed that the plug 15 withdraws from the connector 11 spontaneously when the lateral force F applied to the USB cable 14 reaches a level (such as 30N).

In the case where the inclined part 37 is formed with a length of more than half the length of the side parts 25, 26 in a direction from the back part 24 toward the insertion opening part 23, the plug 15 easily withdraws from the connector 11 when the lateral force F is applied to the USB cable 14. This further prevents the terminal portion 22 of the connector 11 from being damaged. In the case where the inclined part 37 is formed in a length of half the length of the side parts 25, 26 in the direction from the insertion opening part 23 toward the back part 24, looseness between the USB plug 15 and the connector 11 can be made reasonably small, thereby preventing damage to the terminal portion 22 and making the connector 11 easy to use.

In the connector 11 to which both the eSATA cable 17 and the USB cable 14 are selectively connectable, the housing 21 must be larger than the outer size of the plug 18 of the eSATA cable 17. This makes it difficult to provide a metal shell suited to the outer size of the plug 15 of the USB cable 14. By providing the inclined part 37 in such an eSATA/USB combo connector, however, the terminal portion 22 of the connector 11 can be prevented from being damaged.

When each of the side parts 25, 26 of the housing 21 comprises a first region 43 to be opposed to the plug 15 of the USB cable 14 and a second region 44 to be opposed to the plug 18 of the eSATA cable 17, and the inclined part 37 is formed in the first region 43, since the inclined part 37 is provided only in a necessary part, the connector 11 can be easily miniaturized as a whole.

In the case where the first and second regions 43, 44 are partially overlapped with each other and the inclined part 37 is provided in a part of the first region 43 which is to be away from the second region 44, the inclined part 37 can be formed by utilizing the step portion 45 generated by the difference between the width W1 of the plug 15 of the USB cable 14 and the width W3 of the plug 18 of the eSATA cable 17. That is, the inclined part 37 is formed by utilizing regions difficult to be effectively used in the eSATA/USB combo connector. This contributes to miniaturization of the connector 11.

In the case where the inclined part 37 is formed in a region to be away from the side of the plug 18 of the eSATA cable 17, the inclined part 37 can be formed by utilizing the step portion 45 generated by difference between the width W1 of the plug 15 of the USB cable 14 and the width W3 of the plug 18 of the eSATA cable 17. Thereby, the connector 11 can be miniaturized.

The present invention is not limited to the above-described portable computer 1 and the connector 1 according to an embodiment of the present invention. The present invention may be practically embodied by modifying the constituent elements without departing from the scope and spirit of the invention.

In the above-described embodiment, an eSATA/USB combo connector is taken as an example, but a connector to which the present invention is applicable is not limited thereto. The present invention may be applied to a connector dedicated to a USB cable comprising a synthetic-resin housing, for example.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A USB connector module comprising:

a connector configured to selectively connect to a first plug and a second plug different than the first plug, the connector comprising, an insertion open portion, a back portion positioned opposite to the insertion open portion, a plurality of first terminals, a plurality of second terminals, first walls, and second walls, wherein the first walls and the second walls are between the insertion open portion and the back portion and the first walls have a first width between them at the insertion open portion and the second walls have a second width between them at the insertion open portion, wherein each first wall comprises a sloped, substantially straight portion and a portion perpendicular to the back wall, wherein the sloped, substantially straight portion is not perpendicular to the back wall, and the length of the sloped, substantially straight portion is equal to or larger than half of the length of each first wall, and wherein the sloped, substantially straight portion extends to the insertion open portion.

2. The USB connector module of claim 1, wherein the first walls face each other.

3. The USB connector module of claim 1, wherein the sloped, substantially straight portion is in a region away from the second plug when the second plug is inserted into the connector.

4. The USB connector module of claim 1, wherein each first wall of the housing comprises a first region configured to face the first plug, and each second wall comprises a second region configured to face the second plug, and the sloped, substantially straight portion is in the first region.

5. The USB connector module of claim 4, wherein the first region and the second region are partially overlapped with each other, and the sloped, substantially straight portion is in the first region away from the second region.

6. The USB connector module of claim 1, wherein the sloped, substantially straight portion is configured to allow the first plug to incline at an angle when a lateral force is applied to the first plug.

7. The USB connector module of claim 6, wherein the sloped, substantially straight portion is configured to allow the first plug to withdraw from the connector when a lateral force is applied to the first plug that exceeds about 30 N.

8. A USB connector card comprising:

an electrical connector configured to connect to a first plug and a second plug different than the first plug, the electrical connector comprising, a first plastic port, a second plastic port, a plurality of first terminals, a plurality of second terminals, an open portion configured to expose a portion of the first plug or the second plug outside of the first plastic port and the second plastic port respectively, and a back portion configured to abut against the first plug and the second plug when the first plug and the second plug are connected to the first port and the second port respectively, wherein the first plastic port comprises a pair of first side walls comprising a first width, wherein the second plastic port comprises a pair of second side walls comprising a proximal portion and a distal portion, the proximal portion comprising a sloped, substantially straight portion extending to the open portion, and the distal portion comprising a second width, and wherein each of the first side walls comprises a first region and each of the second side walls comprises a second region, wherein the first region and the second region partially overlap with each other, and the sloped, substantially straight portion is in the second region away from the first region.

9. The USB connector card of claim 8, wherein the pair of first side walls face each other.

10. The USB connector card of claim 8, wherein the first region is configured to face the first plug, and the second region is configured to face the second plug, and the sloped, substantially straight portion is in the second region.

11. The USB connector card of claim 8, wherein the first plastic port is configured to operably connect to an eSATA plug, and the second plastic port is configured to operably connect to an USB plug.

12. The USB connector card of claim 8, wherein the sloped, substantially straight portion is configured to allow the second plug to incline at an angle when a lateral force is applied to the second plug.

13. The USB connector card of claim 12, wherein the sloped, substantially straight portion is configured to allow the second plug to withdraw from the connector spontaneously when a lateral force is applied to the second plug that exceeds about 30 N.

* * * * *